US010578073B2

(12) United States Patent
Lykowski et al.

(10) Patent No.: US 10,578,073 B2
(45) Date of Patent: Mar. 3, 2020

(54) IGNITER ASSEMBLY, INSULATOR THEREFOR AND METHODS OF CONSTRUCTION THEREOF

(71) Applicant: FEDERAL-MOGUL LLC, Southfield, MI (US)

(72) Inventors: James D. Lykowski, Temperance, MI (US); Paul William Phillips, Brighton, MI (US)

(73) Assignee: Tenneco Inc., Lake Forest, IL (US)

( * ) Notice: Subject to any disclaimer, the term of this patent is extended or adjusted under 35 U.S.C. 154(b) by 29 days.

(21) Appl. No.: 15/949,296

(22) Filed: Apr. 10, 2018

(65) Prior Publication Data

US 2018/0291863 A1 Oct. 11, 2018

Related U.S. Application Data

(60) Provisional application No. 62/484,364, filed on Apr. 11, 2017.

(51) Int. Cl.

| | |
|---|---|
| ***F02P 23/04*** | (2006.01) |
| ***H01T 19/04*** | (2006.01) |
| ***H01T 13/36*** | (2006.01) |
| ***H01T 21/02*** | (2006.01) |
| ***H01T 13/50*** | (2006.01) |
| *F02P 3/01* | (2006.01) |

(52) U.S. Cl.

CPC ..... *F02P 23/04* (2013.01); *H01T 13/36* (2013.01); *H01T 13/50* (2013.01); *H01T 19/04* (2013.01); *H01T 21/02* (2013.01); *F02P 3/01* (2013.01)

(58) Field of Classification Search

CPC .. F02P 23/04; F02P 3/01; H01T 21/02; H01T 13/50; H01T 13/36; H01T 19/04

USPC ..... 123/143 B, 169 E, 169 P

See application file for complete search history.

(56) References Cited

U.S. PATENT DOCUMENTS

| | | | |
|---|---|---|---|
| 6,603,245 | B1 | 8/2003 | Fletcher |
| 7,057,332 | B2 | 6/2006 | Burrows |
| 8,749,126 | B2 | 6/2014 | Durham et al. |

(Continued)

FOREIGN PATENT DOCUMENTS

| | | | |
|---|---|---|---|
| EP | 2216863 | A2 | 8/2010 |
| WO | 2017031390 | A1 | 2/2017 |

OTHER PUBLICATIONS

Communication Relating to the Results of the Partial International Search, dated Jul. 12, 2018 (PCT/US2018/027050).

*Primary Examiner* — Hai H Huynh

(74) *Attorney, Agent, or Firm* — Robert L. Stearns; Dickinson Wright PLLC

(57) ABSTRACT

An igniter, such as a corona igniter for an internal combustion engine, and a method of manufacturing the igniter, are provided. The igniter includes an insulator with enlarged upper and lower end regions extending axially beyond opposite ends of a constrained, reduced diameter region of a shell through passage. The enlarged lower end region of the insulator is disposed axially outwardly of a lower end of the shell. The insulator is hermetically sealed to the shell and is permanently fixed against being removed axially outwardly from the shell. The method can include conforming the shell to the contour of the insulator by plastically deforming the shell, or casting the shell about the insulator. Alternatively, separate pieces of metal can be disposed around the insulator to form the shell which is conformed to the insulator.

20 Claims, 8 Drawing Sheets

(56) References Cited

U.S. PATENT DOCUMENTS

| | | | | |
|---|---|---|---|---|
| 9,065,256 | B2 | 6/2015 | Makarov et al. | |
| 9,941,671 | B2 * | 4/2018 | Mixell | F02P 23/04 |
| 10,056,737 | B2 * | 8/2018 | Burrows | H01T 13/50 |
| 10,056,738 | B2 * | 8/2018 | Burrows | H01T 13/50 |
| 2010/0203791 | A1 | 8/2010 | Suzuki et al. | |

* cited by examiner

IGNITER ASSEMBLY, INSULATOR THEREFOR AND METHODS OF CONSTRUCTION THEREOF

CROSS REFERENCE TO RELATED APPLICATIONS

This U.S. Utility Patent Application claims the benefit of U.S. Provisional Patent Application Ser. No. 62/484,364, filed Apr. 11, 2017, the entire disclosure of the application being considered part of the disclosure of this application, and hereby incorporated by reference.

BACKGROUND

1. Field of the Invention

This invention relates generally to igniters used for igniting a fuel-air mixture in an internal combustion engine, and to the construction and method of making the insulator and shell of such igniters.

2. Related Art

Igniters for internal combustion engines are known for use in igniting an air-fuel mixture, and can include spark ignition devices and/or corona ignition devices and may include others. Such igniters often include an insulator of generally tubular construction which typically would house an electrode and be surrounded on the outside by steel shell which can be threaded at its lower end into a socket in the head of the engine in open communication with a combustion chamber. The upper end of the assembly is typically connected to a power source and the igniter operates in service to generate a controlled spark, corona discharge, plasma discharge, etc., for igniting the fuel-air mixture in the combustion chamber.

FIGS. 11 and 12 illustrate igniters 1, shown as an igniter for a corona ignition system, by way of example, showing configurations of an insulator 2 and a shell 3. FIGS. 11 and 12 are used herein for explanatory purposes to assist in distinguishing inventive subject matter of the present disclosure, and are not acknowledged as being prior art. In FIG. 11, a "forward" assembly technique is used to assemble the insulator 2 into an upper end 4 of the shell 3, while in FIG. 12, a "reverse" assembly technique is used to assemble the insulator 2 into a lower end 5 of the shell 3. In both cases, the portion of the insulator 2 that is being inserted through a through passage 6 of the shell 3 has a maximum insulator diameter (ID) that is less than a minimum shell diameter (SD) of the through passage 6. This naturally limits the size of the insertion end of the insulator 2 since it must fit through the opening in the shell 3.

In some ignition applications, it has been found advantageous for ignition performance and durability to have the insulator 2 larger than the minimum diameter of the shell through passage 6, and thus, designers must presently decide which end of the insulator 2 to provide a relatively enlarged end, while leaving the opposite end having a reduced diameter sufficient to pass through the minimum diameter of the shell through passage 6. If performing a forward assembly technique, an upper end of the insulator 2 can be provided having an enlarged end 7 (FIG. 11), and if performing a reverse assembly technique, a lower end of the insulator 2 can be provided having an enlarged end 8 (FIG. 12). In either case, the end opposite the enlarged end 7, 8 must remain sufficiently small to be able to be inserted through the minimum diameter of the through passage 6. Attempts have been made to add secondary enlarging insulating components 9 to the relatively small end of the insulator 2, and although met with some success, improvements in both performance and durability are desired. Some drawbacks typically occur due the high electrical, mechanical, and thermal stresses placed on the joint between the insulator 2 and the secondary enlarging insulating components 9, thereby resulting in a less than optimal ignition event, thereby resulting in a less than optimal performance. Further yet, the joint between the insulator 2 and second component 9 lends itself to corrosion, separation and failure, thereby resulting in a less than optimal durability. Further yet, having to perform secondary operations to incorporate secondary components adds complexity and cost to the process and the igniter.

SUMMARY

One aspect of the invention provides a corona igniter. The corona igniter comprises an insulator surrounding a central electrode, and a shell formed of metal surrounding the insulator. The insulator has an insulator outer surface including an insulator intermediate region between an insulator upper end region and an insulator lower end region. The intermediate region has a maximum first diameter ID1, the insulator upper end region has a minimum second diameter ID2, and the insulator lower end region has a minimum third diameter ID3. The minimum second diameter ID2 and the minimum third diameter ID3 are both greater than the maximum first diameter D1. The shell has a shell outer surface including a threaded region with a plurality of threads. The shell also has a shell inner surface including a shell lower end region radially aligned with the threaded region. The shell lower end region has a maximum inner diameter 5131 which is less than the minimum second diameter ID2 and the minimum third diameter ID3 of the insulator outer surface. The shell is also plastically deformed such that the shell inner surface conforms with the contour of the insulator intermediate region and at least a portion of the insulator upper end region, and the insulator lower end region extends axially outwardly from a shell lower end of the shell.

Another aspect of the invention provides a corona igniter comprising an insulator surrounding a central electrode, and a shell formed of metal surrounding the insulator. The insulator has an insulator outer surface including an insulator intermediate region between an insulator upper end region and an insulator lower end region. The insulator intermediate region has a maximum first diameter ID1, the insulator upper end region has a minimum second diameter ID2, and the insulator lower end region having a minimum third diameter ID3, wherein the minimum second diameter ID2 and the minimum third diameter ID3 are both greater than the maximum first diameter D1. The shell has a shell outer surface including a threaded region with a plurality of threads. The shell also has a shell inner surface including a shell lower end region radially aligned with the threaded region. The shell lower end region has a maximum inner diameter which is less than the minimum second diameter ID2 and the minimum third diameter ID3 of the insulator outer surface. The shell includes separate pieces, and the shell inner surface conforms with the contour of the insulator intermediate region and at least a portion of the insulator upper end region. The insulator lower end region also extends axially outwardly from a shell lower end of the shell.

Another aspect of the invention provides a method of manufacturing an igniter. The method comprises the steps of: providing an insulator having an insulator outer surface including an insulator intermediate region between an insulator upper end region and an insulator lower end region, the insulator intermediate region having a maximum first diameter ID1, the insulator upper end region having a minimum second diameter ID2, and the insulator lower end region having a minimum third diameter ID3, wherein the minimum second diameter ID2 and the minimum third diameter ID3 are both greater than the maximum first diameter D1; and inserting the insulator lower end region though a shell upper end of a shell formed of metal and past a shell lower end of the shell. The method further includes plastically deforming the shell such that a shell inner surface of the shell conforms with the contour of the insulator intermediate region.

Yet another aspect of the invention provides a method of manufacturing an igniter, comprising the steps of: providing an insulator having an insulator outer surface including an insulator intermediate region between an insulator upper end region and an insulator lower end region, the insulator intermediate region having a maximum first diameter ID1, the insulator upper end region having a minimum second diameter ID2, and the insulator lower end region having a minimum third diameter ID3, wherein the minimum second diameter ID2 and the minimum third diameter ID3 are both greater than the maximum first diameter D1; and disposing separate pieces of a shell formed of metal around the insulator outer surface, a shell inner surface of the pieces of the shell conforming with the contour of the insulator intermediate region and at least a portion of the insulator upper end region.

Another aspect of the invention provides method for manufacturing an igniter, comprising the steps of: providing an insulator having an insulator outer surface including an insulator intermediate region between an insulator upper end region and an insulator lower end region, the insulator intermediate region having a maximum first diameter ID1, the insulator upper end region having a minimum second diameter ID2, and the insulator lower end region having a minimum third diameter ID3, wherein the minimum second diameter ID2 and the minimum third diameter ID3 are both greater than the maximum first diameter D1; and casting a shell formed of metal about the insulator such that a shell inner surface of the shell conforms with the contour of the insulator intermediate region and at least a portion of the insulator upper end region, and a shell lower end of the shell is located axially above the insulator lower end region.

BRIEF DESCRIPTION OF THE DRAWINGS

These and other features and advantages will become readily apparent to those skilled in the art in view of the following detailed description of the presently preferred embodiments and best mode, appended claims, and accompanying drawings, in which:

DETAILED DESCRIPTION OF PRESENTLY PREFERRED EMBODIMENTS

Figure 1:
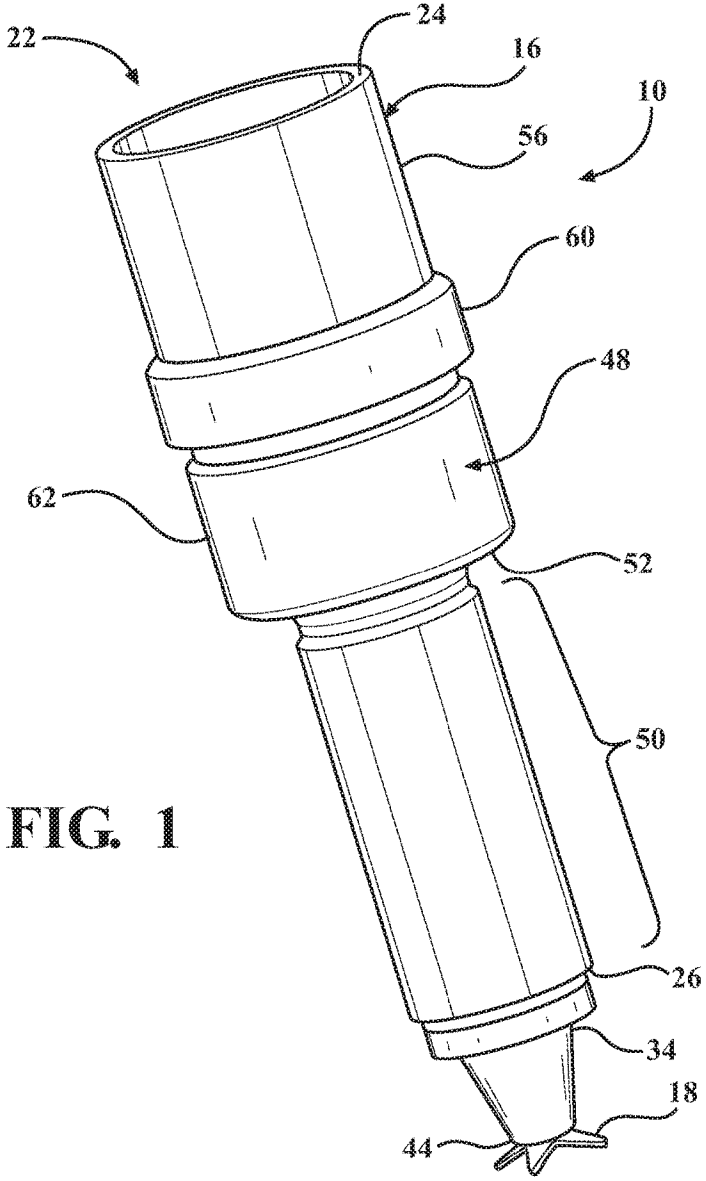
FIG. 1 is a perspective view of an igniter in accordance with one aspect of the invention.

Referring in more detail to the drawings, FIG. 1 illustrates an igniter, shown as a corona igniter, by way of example and without limitation, referred to hereafter simply as igniter 10, constructed in accordance with one aspect of the disclosure. The igniter 10 includes a central electrode 12 for receiving a high radio frequency voltage, a monolithic, one-piece insulator 14 surrounding the central electrode 12, and a metal shell 16 surrounding the insulator 14. The central electrode 12 includes a corona-enhancing tip 18 for emitting a radio frequency electric field, sometimes referred to as "streamers", to ionize a fuel-air mixture and provide a corona discharge within a cylinder bore of an internal combustion engine. The metal shell 16 has an inner surface 20 bounding a through passage 22 that extends between opposite open upper and lower ends 24, 26. The through passage 22 has a reduced diameter region 28 through which the insulator 14 fully extends. The insulator 14 has an intermediate region 30 extending between opposite upper and lower end regions 32, 34. The upper and lower end regions 32, 34 of the insulator 14 are enlarged relative to the reduced diameter region 28 of the shell 16 such that they are prevented from being able to pass through the reduced diameter region 28 of the shell 16. As will be appreciated by one skilled in the art, with the one-piece insulator 14 having enlarged, generally bulbous upper and lower end regions 32, 34, the ignition performance, durability and useful life of the igniter 10 are enhanced without having to add additional, secondary insulative material adjacent the ends 32, 34 of the insulator 14.

The central electrode 12 of the igniter 10 is formed of an electrically conductive material, such as a nickel alloy, for example, for receiving a voltage sufficient to cause an ignition event, and in the case of a corona-type igniter, for example, a high radio frequency voltage, typically in the range of 20 to 75 KV peak/peak, by way of example and without limitation. The central electrode 12 also emits energy sufficient to cause an ignition event, and in the case of a corona-type igniter, for example, a high radio frequency electric field, typically in the range of 0.9 to 1.1 MHz, again by way of example and without limitation. The central electrode 12 extends longitudinally along a center axis A from a terminal end 36 to an electrode firing end 38. The central electrode 12 typically includes the corona enhancing tip 18 at the electrode firing end 38, wherein the tip 18 includes a plurality of radially outwardly extending prongs, typically formed of nickel, nickel alloy, copper, copper alloy, iron, or iron alloy, for example.

Figure 2:
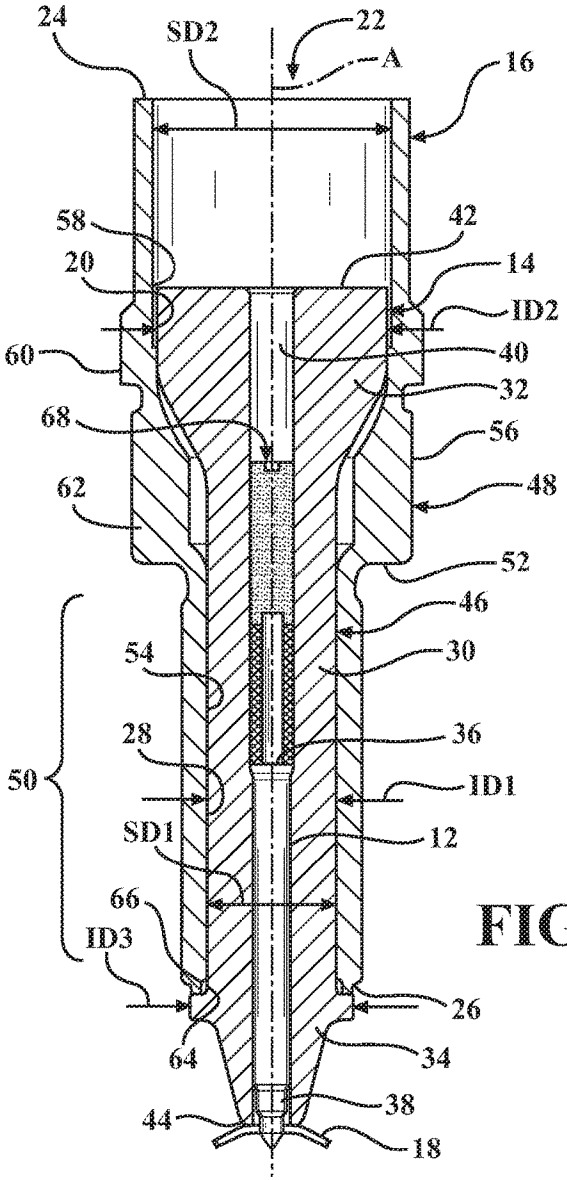
FIG. 2 is a cross-sectional view of the igniter of FIG. 1.

The insulator 14 of the corona igniter 10 is formed of an electrically insulating material, such as alumina, by way of example and without limitation. The insulator 14 has an inner surface 40 defines a through bore sized for receipt of the central electrode 12 therein and extends longitudinally along the center axis A from an insulator upper end 42 to an insulator lower end, also referred to as nose end 44. The insulator 14 has an insulator outer surface 46, wherein the outer surface 46 is typically circular, as viewed in lateral cross-section, such that the outer surface 46 has a diameter. The outer surface 46 extending along the insulator intermediate region 30 has a maximum first diameter ID1 (FIG. 2); the outer surface 46 extending along the insulator upper end region 32 has a minimum second diameter ID2 (FIG. 2); and the outer surface 46 extending along the insulator lower end region 34 has a minimum third diameter ID3 (FIG. 2), wherein ID2 and ID3 are both greater than ID1. In the embodiment shown, ID1 has a constant or substantially constant diameter extending along the full length of the intermediate region 30, by way of example and without limitation. The insulator outer surface 46 also includes an insulator nose region.

The shell 16 can be formed of a plastically deformable metal material, such as steel, by way of example and without limitation. The shell 16 has a shell outer surface 48 facing radially outwardly and away from the axis A and extending generally along the direction of the center axis A from the shell upper end 24 to the shell lower end 26. The shell inner surface 20 surrounds a portion of the insulator 24, shown as surrounding the intermediate and upper end regions 30, 32, with the insulator lower end region 34 extending axially outwardly from the lower end 26 of the shell 16. The shell outer surface 48 has a threaded region 50 configured for threaded engagement with a threaded bore in a cylinder head of an engine (not shown). The threaded region 50 and a corresponding lower region 54 of the inner surface 20, radially aligned inwardly with the threaded region 50, are shown as extending from the lower end 26, or from adjacent the shell lower end 26, axially toward the upper end 24 to a radially outwardly extending shoulder 52. The lower region 54 of the inner surface 20 has a maximum lower diameter SD1 (FIG. 2), wherein SD1 is less than ID2 and ID3. Accordingly, the maximum outer diameters ID2, ID3 of both the upper and lower ends 42, 44 of the insulator 14 are not limited as to how large they can be by the minimum diameter of the shell through passage 22.

The shell shoulder 52 provides a seat for sealing abutment against a mount surface of the engine cylinder head, though it is contemplated that an annular seal member could be disposed against the shoulder 52 to perfect a seal, if desired. In some example embodiments, the shell 16 is plastically deformed in the threaded region 50 adjacent the shoulder 52. The shoulder 52 extends radially outwardly and transitions into an axially extending enlarged region 56 of the outer surface 48, wherein an upper region 58 of the shell inner surface 20, extending opposite and generally parallel with the enlarged region 56, flares radially outwardly to provide a minimum upper diameter SD2 (FIG. 2), wherein SD2 is greater than ID2. The enlarged diameter regions 56, 58 are shown as extending to the shell upper end 24. To facilitate fastening the igniter 10 to the cylinder head of the engine, at least a portion of the outer surface enlarged region 56 can be formed having a tool receiving section 60, such as a hexagonal shaped region, for example.

Figure 3:
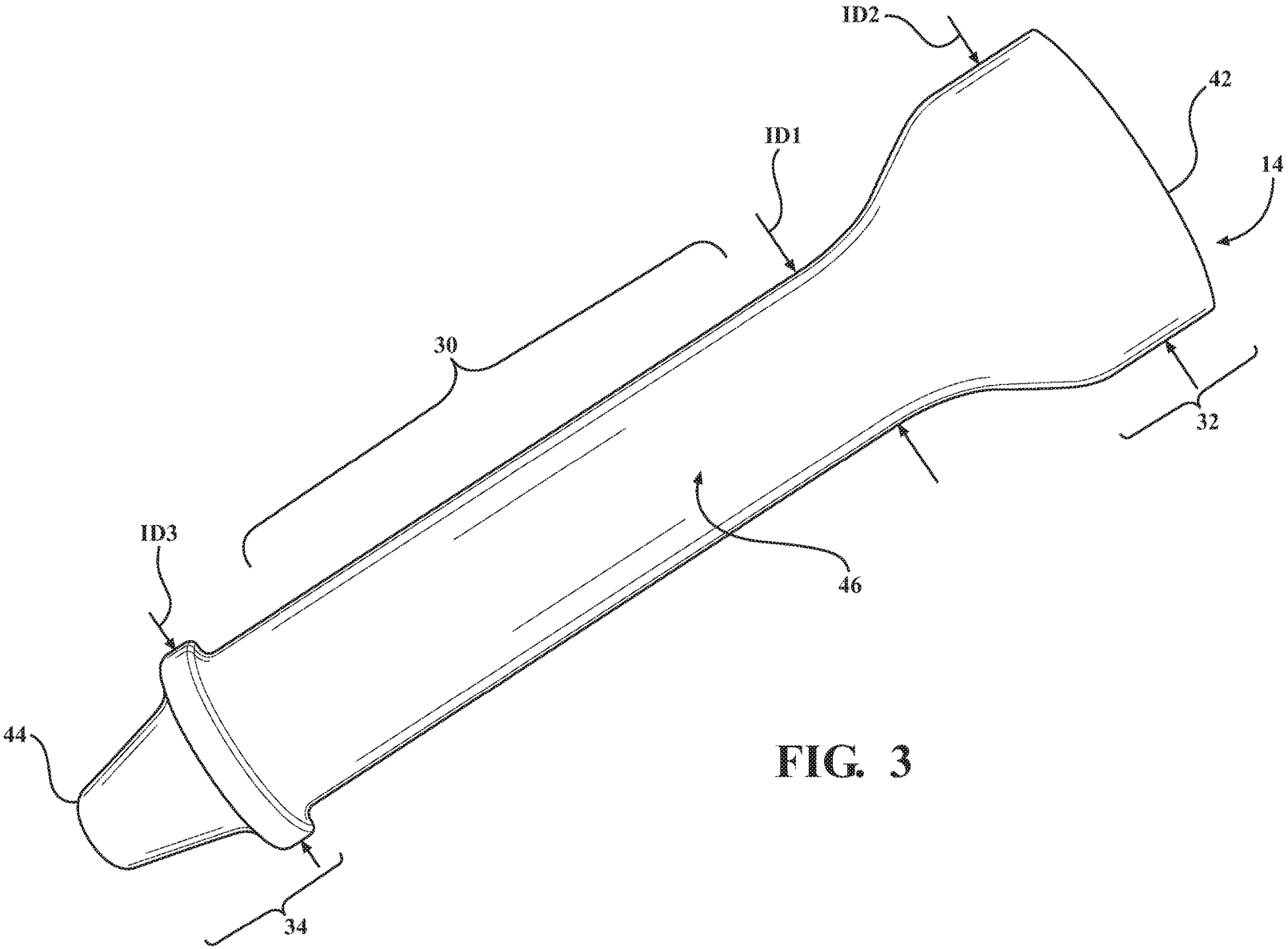
FIG. 3 is a perspective view of an insulator shown in accordance with a further aspect of the invention.
Figure 10:
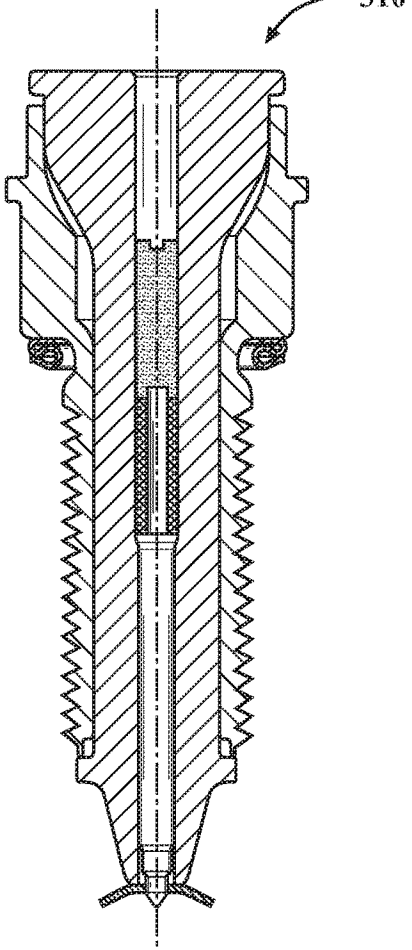
FIGS. 8-10 illustrate cross-sectional views of different igniters constructed in accordance further aspects of the invention.
Figure 9:
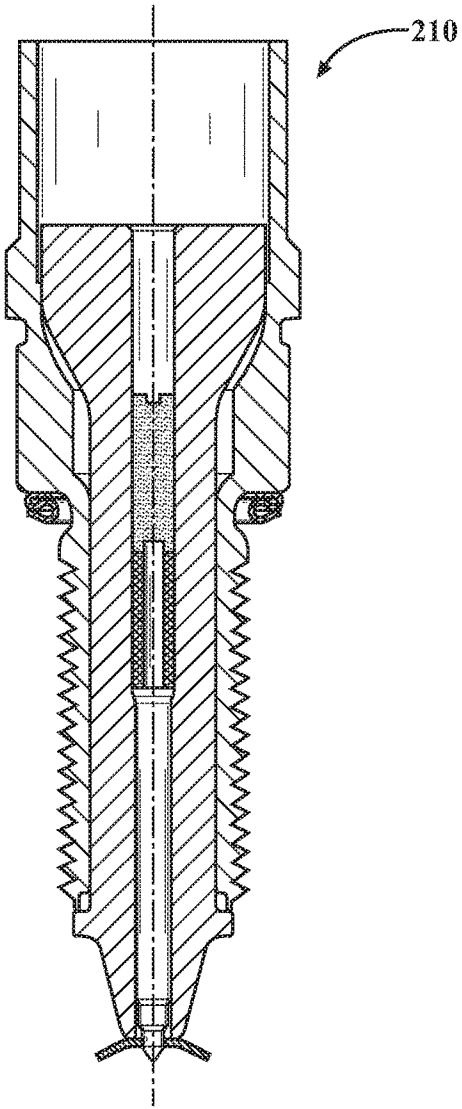
Figure 8:
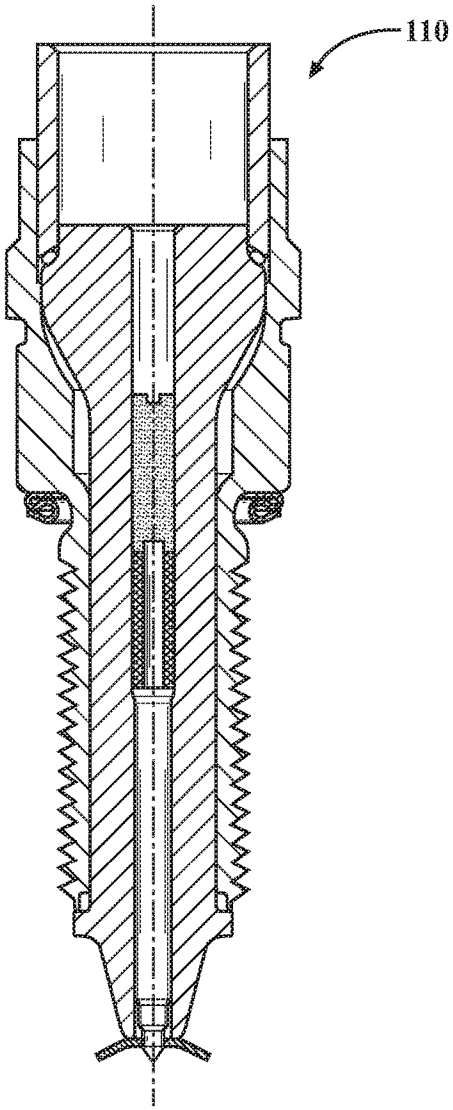
Figure 11:
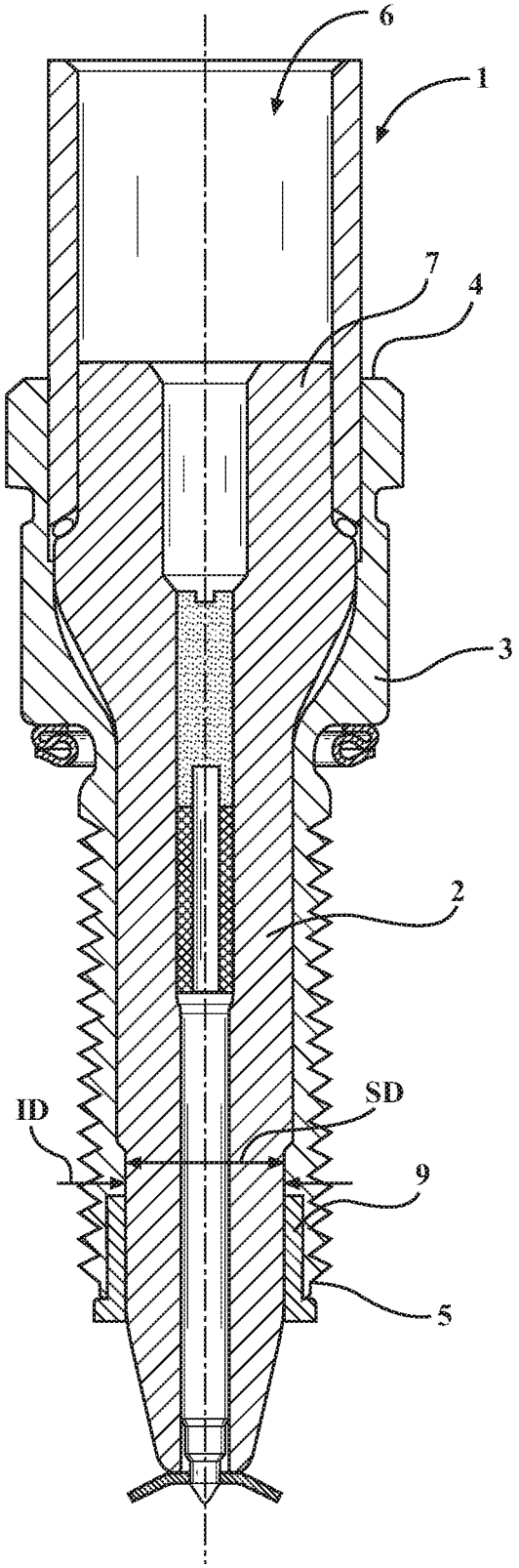
FIGS. 11 and 12 illustrate igniters that are not in accordance with the invention, but rather, identify issues and problems that the current invention resolves.
Figure 12:
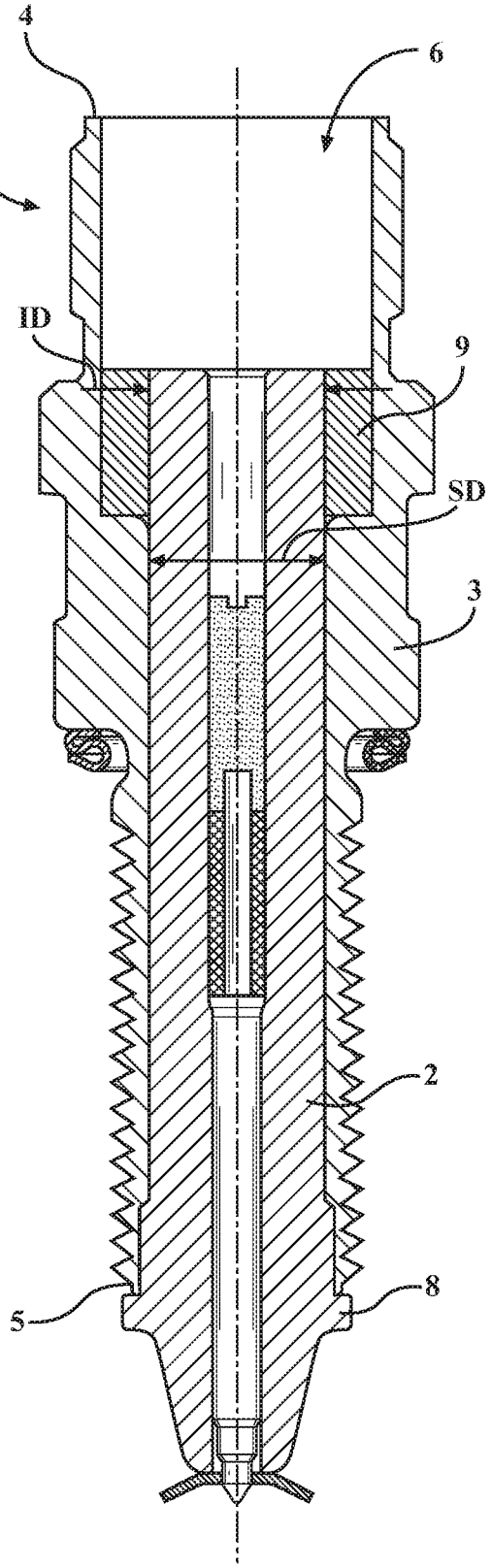

In construction of the igniter 10, the insulator 14 is provided as a single piece of insulative material having the desired finish shape, such as shown in FIG. 3, by way of example and without limitation. Regardless of particular details of the finish shape which can be altered for different engine applications, the finish shape includes upper and lower end regions 32, 34 having respective portions with minimum outer diameters ID2, ID3 spaced axially from one another by an intermediate region 30 having a maximum outer diameter ID1, wherein the identified minimum outer diameters ID2, ID3 of the upper and lower end regions 32, 34 are greater than the maximum outer diameter ID1 of the intermediate region 30. It will be recognized by one skilled in the art that within the specific regions 30, 32, 34, specific features and configurations thereof can be provided as desired for the intended application. This is evidenced in FIGS. 8-10 illustrating igniters 110, 210, 310 constructed in accordance with different embodiments of the invention.

Figure 4C:
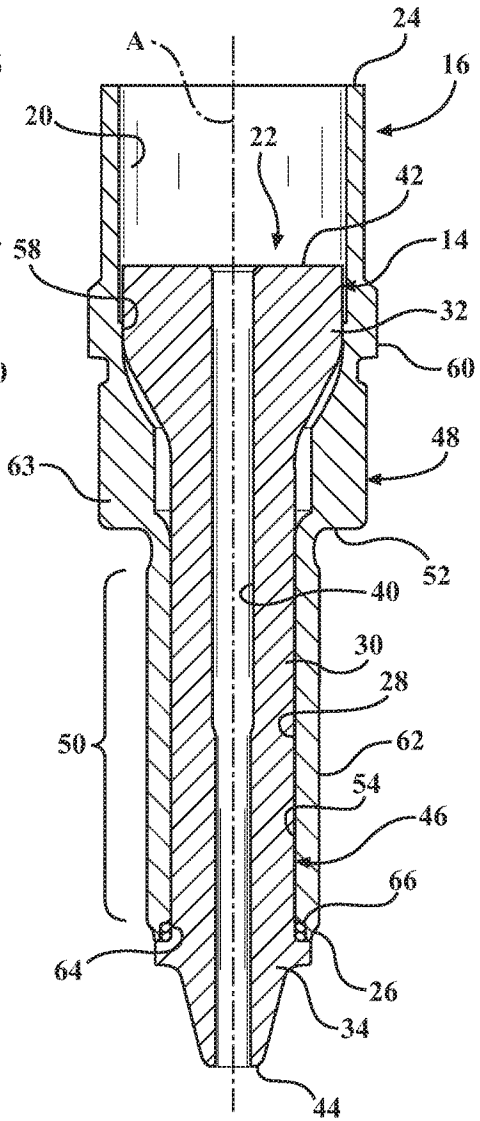
FIGS. 4A-4C illustrate steps used to construct an igniter in accordance with a further aspect of the invention.
Figure 4B:
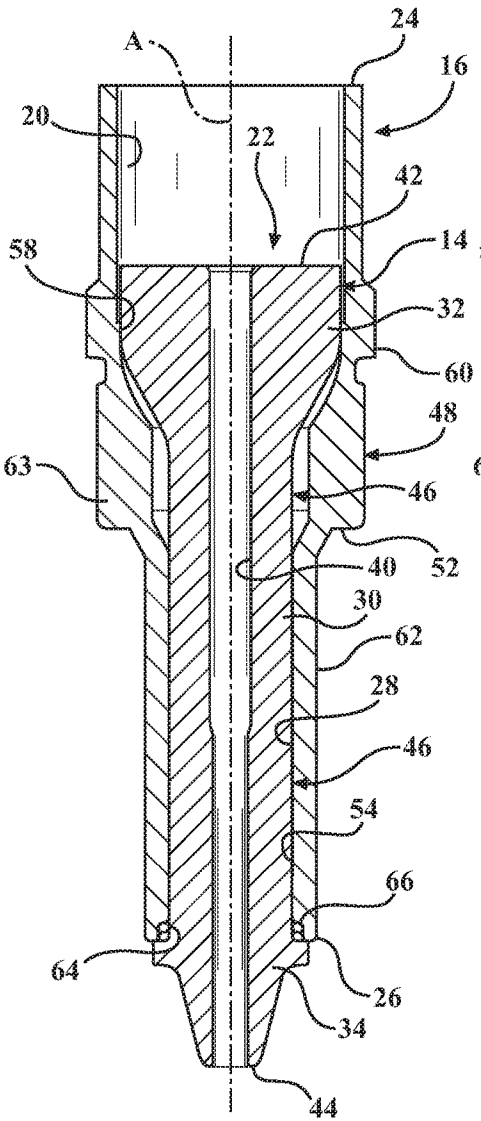
Figure 4A:
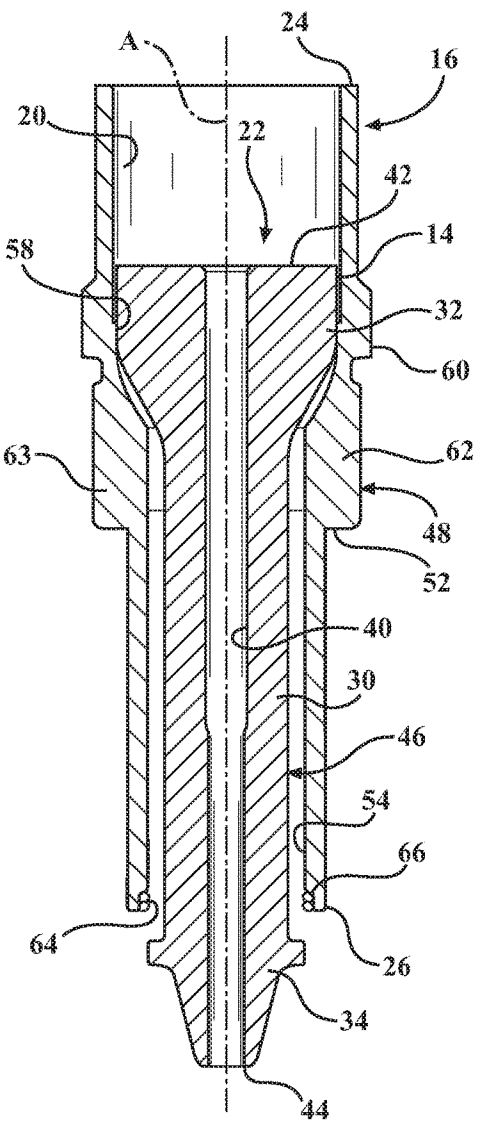

In FIGS. 4A-4C, one method 100 is illustrated showing steps of constructing an igniter 10 in accordance with one aspect of the invention. As illustrated in FIG. 4A, the metal shell 16 can be provided in the initial stage of construction as a single piece of metal material having a tubular body 62 with a circumferentially continuous, seamless wall 63 with an inner surface 20 bounding a through passage 22 that extends between opposite upper and lower ends 24, 26. The metal shell 16, at the initial stage, can also have a ductile nickel plating deposited thereon to enhance corrosion resistance and to facilitate a downstream braze sealing process, wherein the plating is durable enough to withstand subsequent forming process steps. Further yet, an annular gasket or seal material 64 can be disposed in a counterbore recess 66 in the lower end 26 of the shell 16 to facilitate the formation of a hermetic seal between the insulator 14 and shell 16. As shown in FIG. 4A, the through passage 22 is enlarged at an upper region 58, extending from the upper end 24 toward the lower end 26, relative to a lower region 54 adjacent the lower end 26. The enlarged upper region 58 of the through passage 22 is sized to receive the upper end region 32 of the insulator therein and the lower end region 34 therethrough, such as in a forward assembly process, while the lower region 54 is shown initially sized having a reduced inner diameter relative to the upper region 58, yet enlarged relative to a finished state so as to enable the lower end region 34 of the insulator 14 to be inserted therethrough.

Upon or during disposing the insulator 14 into the shell 16, a braze material can be disposed between a select region or regions of the insulator and shell 16 for subsequent brazing to further promote forming a hermetic seal between the insulator 14 and shell 16. To facilitate brazing, at least the region of the insulator 14 where brazing is performed can be metalized. Then, as shown in FIG. 4B, the shell 16 is plastically deformed in a forming operation to substantially conform the shell inner surface 20 with the contour of the insulator outer surface 46, leaving annular gaps where desired to inhibit arcing. The forming operation can be performed via one of a plurality of metal forming processes, including, by way of example and without limitation, a cold forming process, such as swaging, extruding, crimping, rolling and end forming, or via a magnetic pulse forming process, also referred to as electromagnetic forming (EM forming) or magneforming, for example. Regardless of the forming process used, upon forming the single piece metal shell 16 about the single piece insulator 14, the insulator 14 is permanently fixed against being removed axially outwardly from the shell 16 as a result of the upper end region 32 and the lower end region 34 both having minimum diameters D2, D3 larger than the maximum inner diameter SD1 within the shell lower region 54. As can be seen in FIG. 4B, the enlarged lower end region 34 is shaped as an annular flange that extends radially outwardly beyond the shell inner surface 20 to substantially confront the shell lower end 26 and constrain the gasket 64 against removal. It is to be understood that other shapes of the enlarged lower end region 34 than that shown are contemplated herein.

Upon forming the shell body 62 about the insulator 14, further forming and/or machining processes can be performed, including forming threads in a thread rolling or thread cutting operation, whereby a threaded region 50 can be formed for threaded engagement with a corresponding threaded opening in a cylinder head. Additional threaded regions can also be formed, such as along the outer surface 48 or inner surface 20 adjacent the shell upper end 24, for example, depending on the intended application requirements. It is to be recognized that the forming and/or machining operations do not cause mechanical stress to, or otherwise damage, the insulator 14 or various coatings when performed by those skilled in the art in view of the teachings herein.

Upon forming the shell 16 and features thereon, additional processes can be performed, including: performing a brazing process in a braze furnace, thereby establishing desired hermetic seals between the insulator 14 and the shell 16; installing an igniter core assembly 68 within a through bore 70 of the insulator 14, including a central electrode 12 and further assembling a corona enhancing tip 18, if constructing a corona-type igniter, to the end of the central electrode 12, if not previously installed.

It is to be recognized that although a forward installation process is discussed above with regard to FIGS. 4A-4C (inserting the insulator 14 into the upper end 24 of the shell 16), that a reverse installation process is contemplated herein (inserting the insulator 14 into the lower end 26 of the shell 16), wherein the respective diameters of the upper and lower end regions 32, 34 can be adjusted accordingly. As such, the upper end region 32 of the insulator 14 can be provided having a smaller or equal diameter ID2 relative to the diameter ID3 of the lower end region 34, but yet still being larger than the diameter ID1 of the intermediate region 30.

Figure 5C:
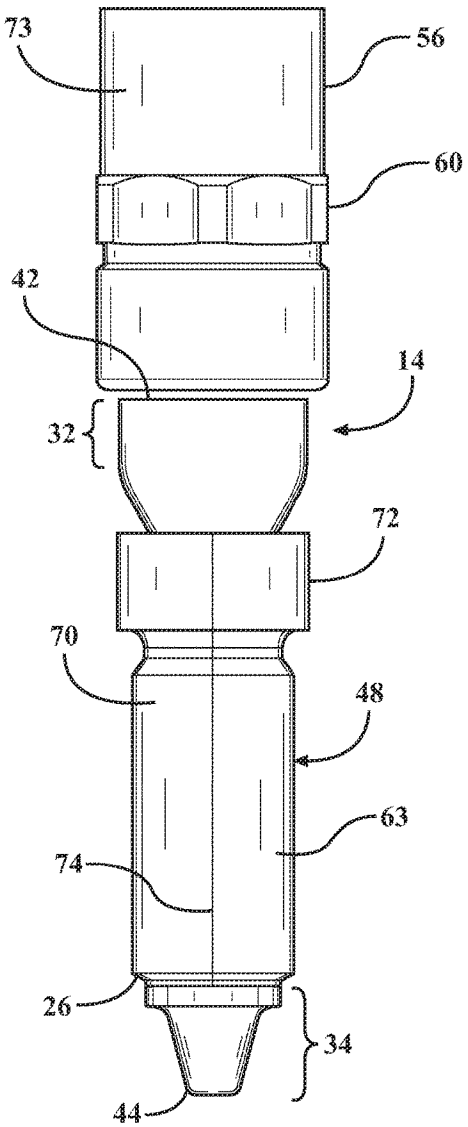
FIGS. 5A-5E illustrate steps used to construct an igniter in accordance with a yet a further aspect of the invention.
Figure 5B:
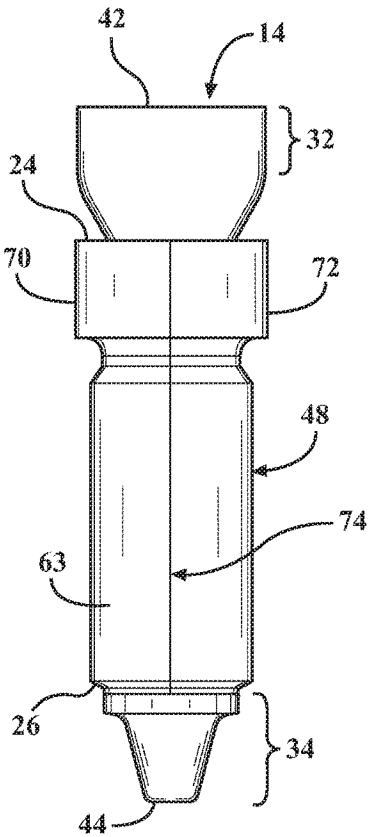
Figure 5A:
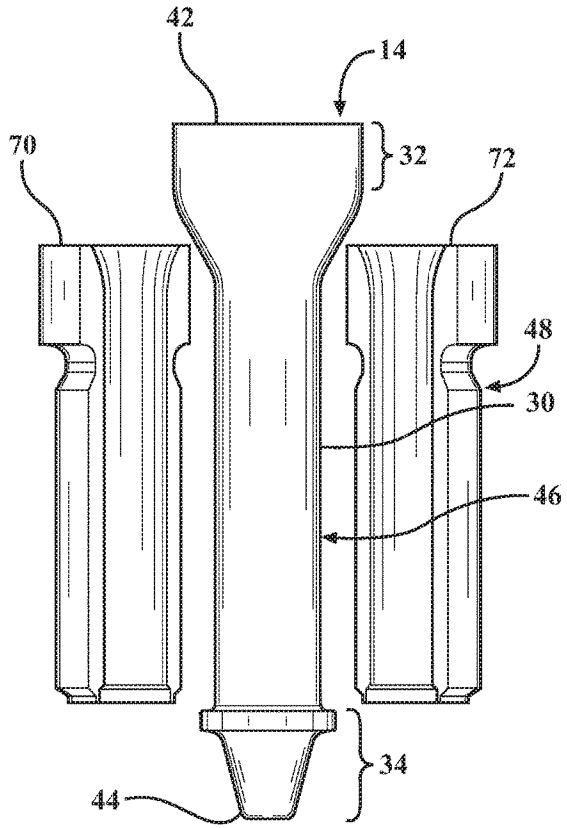

In FIGS. 5A-5E, another method 200 is illustrated showing steps of constructing an igniter 10 in accordance with another aspect of the invention. As illustrated in FIG. 5A, the metal shell 16 can be provided in the initial stage of construction as a plurality of separate pieces of metal material, including separate halves 70, 72, by way of example and without limitation. The separate pieces can be coated, at least in part, with a corrosion resistant layer of nickel or other suitable material, as discussed above. The separate halves 70, 72 are configured to be joined together to form a tubular body 62 having a circumferentially continuous wall 63, with an inner surface 20 bounding a through passage 22 sized for receipt of the insulator 14 therein. Unlike the embodiment illustrated in FIGS. 4A-4C, a cold forming process to conform the shell 16 about the insulator 14 is not necessary, as the shell pieces 70, 72 can be pre-shaped and sized to provide the desired finish fit about the insulator 14 upon being fixed thereabout. In addition to the shell halves 70, 72, a further shell piece 73, shown as being tubular, can be provided to form the upper end 24 and enlarged diameter region 60, if desired. It is contemplated herein that the separate halves 70, 72 could be configured to form the entirety of the shell 16, including the upper enlarged diameter region 56, if desired; however, it is contemplated that material savings may be attained by forming the enlarged diameter region 56 from a separate piece of metal tubing.

Figure 6:
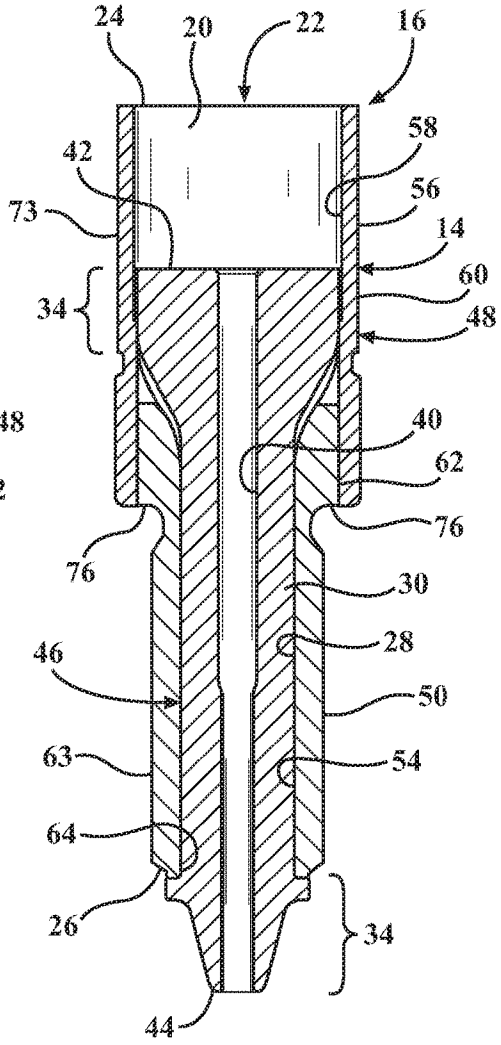
FIG. 6 is a cross-sectional view illustrating a shell and insulator assembly upon completing the construction steps of FIGS. 5A-5E.
Figure 5E:
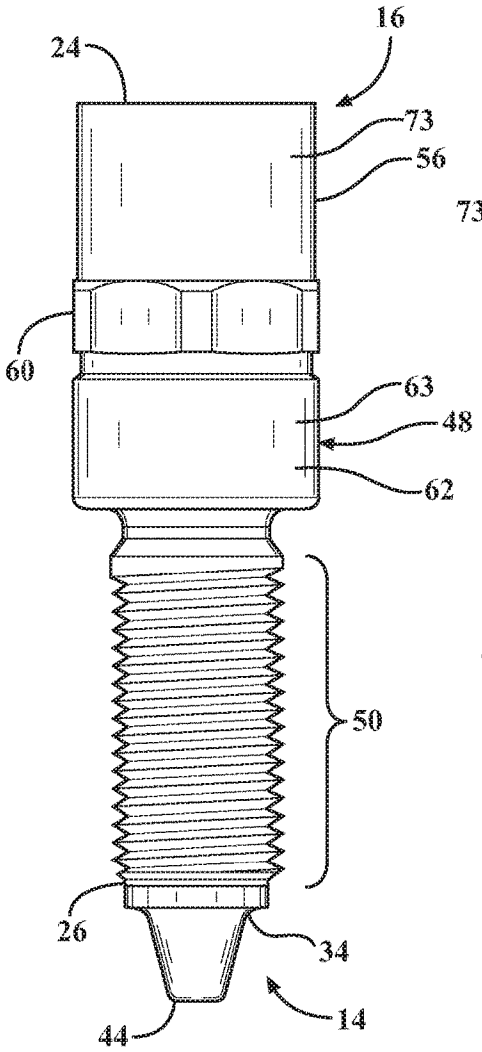
Figure 5D:
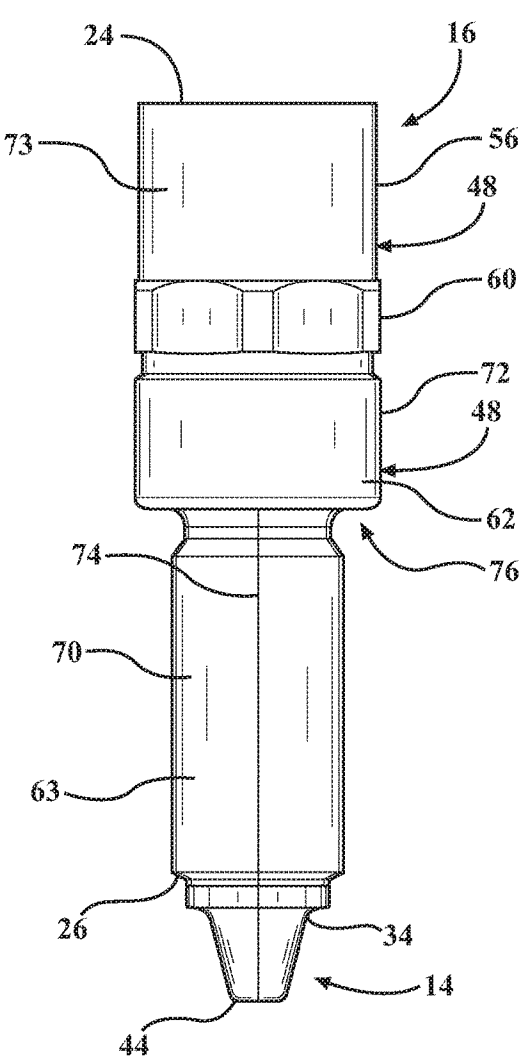

As shown in FIG. 5B, upon assembling the pieces 70, 72 of the shell 16 about the intermediate region 30 of the insulator 14, wherein the aforementioned gasket 64 can also be inserted, the separate pieces 70, 72 can be fixed to one another via weld seams 74 in a welding operation, such as a laser welding operation, by way of example and without limitation. Then, as shown in FIG. 5C, if provided as a separate piece, the enlarged diameter tubular region 56 can be brought into concentrically aligned abutment with the welded, reduced diameter region 28, shown as being disposed in part about an outer surface of the welded, reduced diameter region 28, and then welded thereto via an annular weld joint 76, such as laser weld joint. Thereafter, the same processes can be performed as discussed above for the single piece shell, namely, brazing (wherein a surface of the insulator can be metallized to facilitate forming a reliable braze), plating, thread forming, including forming a threaded region 50 for fixation to the cylinder head, and elsewhere, as needed. FIG. 6 is a cross-sectional view of the insulator and shell after the welding step.

Figure 7C:
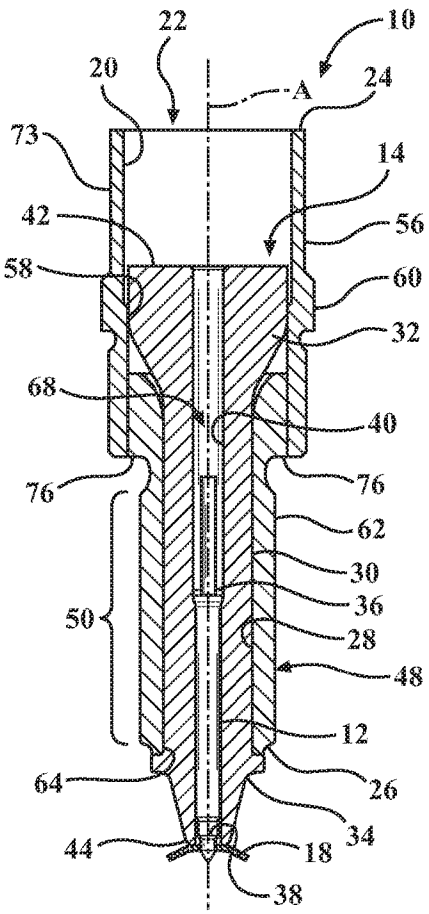
FIGS. 7A-7C illustrate cross-sectional views of an igniter being constructed in accordance with the steps similar to those illustrated FIGS. 5A-5E in accordance with yet a further aspect of the invention, with a central electrode assembly disposed in the insulator throughout the construction steps.
Figure 7B:
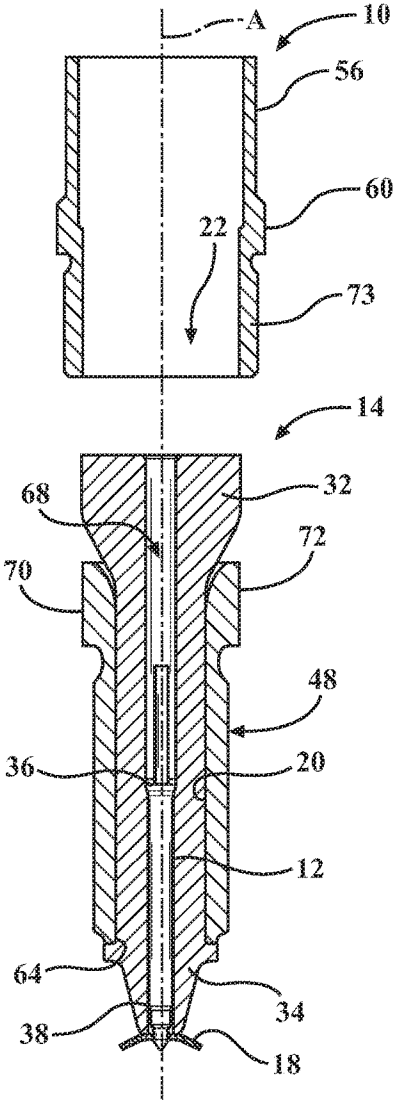
Figure 7A:
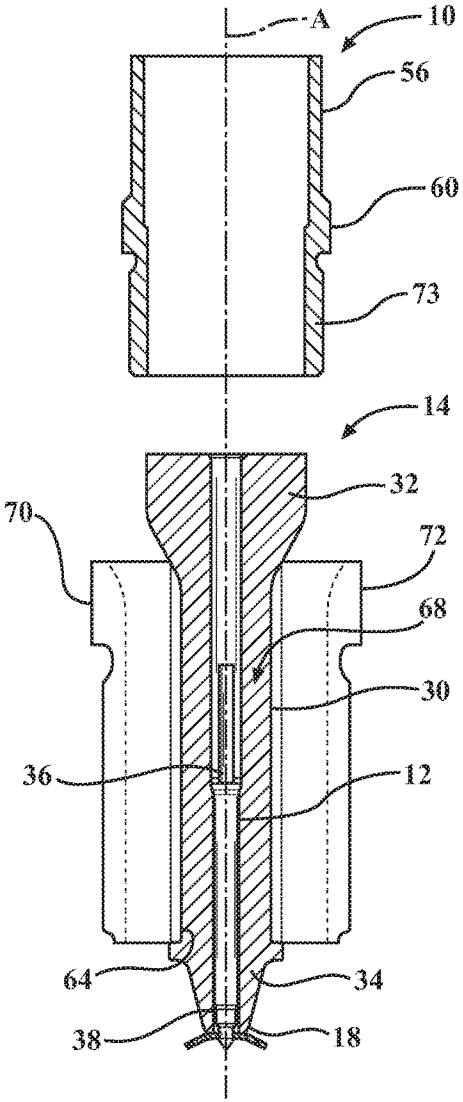

In FIGS. 7A-7C, another method 300 is illustrated showing steps of constructing an igniter 10 in accordance with another aspect of the invention. The method 300 is similar to the method 200; however, a central electrode assembly, including a central electrode 12 and firing tip 18, are disposed within an insulator 14 prior to disposing the shell 16 thereabout. Otherwise, the process is the same as discussed above for the process illustrated in FIGS. 5A-5E.

In accordance with yet another aspect of the invention, the metal shell can be cast about the insulator, and upon casting, any desired secondary operations, can be performed, such as thread forming, if not already cast into the shell.

Obviously, many modifications and variations of the present invention are possible in light of the above teachings and may be practiced otherwise than as specifically described while remaining within the scope of the appended claims. In particular, all features of all claims and of all embodiments can be combined with each other, as long as they do not contradict each other.

What is claimed is:

1. A corona igniter, comprising:

an insulator surrounding a central electrode;

said insulator having an insulator outer surface including an insulator intermediate region between an insulator upper end region and an insulator lower end region;

said insulator outer surface presents an insulator diameter being less than or equal to a maximum first diameter ID1 along said insulator intermediate region, said insulator diameter being greater than or equal to a minimum second diameter ID2 along said insulator upper end region, and said insulator diameter being greater than or equal to a minimum third diameter ID3 along said insulator lower end region, wherein said minimum second diameter ID2 and said minimum third diameter ID3 are both greater than said maximum first diameter D1;

and said insulator diameter tapers along a lower portion of said insulator upper end region in a direction moving away from an insulator upper end and ending at said insulator intermediate region;

a shell formed of metal surrounding said insulator;

said shell having a shell outer surface including a threaded region with a plurality of threads;

said shell having a shell inner surface including a shell lower end region radially aligned with said threaded region;

said shell lower end region having a maximum inner diameter SD1 which is less than said minimum second diameter ID2 and said minimum third diameter ID3 of said insulator outer surface;

said shell being plastically deformed such that said shell inner surface conforms with the contour of said insulator intermediate region; and said insulator lower end region extending axially outwardly from a shell lower end of said shell.

2. A corona igniter according to claim 1, wherein said insulator lower end region extends axially outwardly from said shell lower end.

3. A corona igniter according to claim 1, wherein said threaded region of said shell outer surface extends axially to a shell shoulder, said shell shoulder provides a seat for sealing abutment against a mount surface of an engine cylinder head.

4. A corona igniter according to claim 3, wherein said shell is plastically deformed along said threaded region adjacent said shell shoulder.

5. A corona igniter according to claim 1, wherein said insulator is permanently fixed against being removed axially outwardly from said shell.

6. A corona igniter according to claim 1, including a braze, sealing material, and/or gasket providing a hermetic seal between said insulator outer surface and said shell inner surface.

7. A corona igniter according to claim 1, wherein said central electrode is formed of an electrically conductive material for receiving a high radio frequency voltage;

said central electrode extends longitudinally along a center axis from a terminal end to an electrode firing end;

said central electrode includes a corona-enhancing tip for emitting a radio frequency electric field in a range of 0.9 to 1.1 MHz;

said corona enhancing tip includes a plurality of radially outwardly extending prongs;

said prongs are formed of nickel, nickel alloy, copper, copper alloy, iron, or iron alloy;

said insulator is a monolithic piece of electrically insulating material extending longitudinally from an insulator upper end to an insulator nose end;

said insulator outer surface includes an insulator nose region extending continuously from said insulator lower end region to said insulator nose end;

said insulator diameter is constant along an upper portion of said insulator upper end region extending from said insulator upper end to said lower portion of said insulator upper end region;

said insulator diameter is constant along said insulator intermediate region from said insulator upper end region to said insulator lower end region;

said insulator diameter increases abruptly at an interface between said insulator intermediate region and said insulator lower end region;

said insulator diameter is constant along said insulator lower end region;

and said insulator diameter decreases abruptly at an interface between said insulator lower end region and said insulator nose region, and said insulator diameter tapers continuously along said insulator nose region to said insulator nose end;

said insulator inner surface defines a through bore receiving said central electrode therein;

said through bore extends longitudinally along said center axis from said insulator upper end to said insulator nose end;

said metal of said shell is steel, said steel is plastically deformable;

said shell outer surface faces radially outwardly and away from said center axis from a shell upper end to a shell lower end;

said shell inner surface surrounds said insulator intermediate and upper end regions;

said insulator lower end region extends axially outwardly from said shell lower end;

said threaded region of said shell extends axially to a shell shoulder;

said shell shoulder provides a seat for sealing abutment against a mount surface of an engine cylinder head;

said shoulder extends radially outwardly and transitions into an axially extending enlarged region of said shell outer surface;

said shell is plastically deformed along said threaded region adjacent said shoulder;

said shell inner surface includes a shell upper region extending opposite said enlarged region of said shell outer surface;

said shell inner surface presents a shell inner diameter, said shell inner diameter along said shell upper region is greater than or equal to a minimum upper diameter SD2;

said minimum upper diameter SD2 is greater than said minimum second diameter ID2 of said insulator outer surface;

said insulator is permanently fixed against being removed axially outwardly from the shell; and a braze, sealing material, and/or gasket provides a hermetic seal between said insulator outer surface and said shell inner surface.

8. A corona igniter, comprising:

an insulator surrounding a central electrode;

said insulator having an insulator outer surface including an insulator intermediate region between an insulator upper end region and an insulator lower end region;

said insulator outer surface presents an insulator diameter being less than or equal to a maximum first diameter ID1 along said insulator intermediate region, said insulator diameter being greater than or equal to a minimum second diameter ID2 along said insulator upper end region, and said insulator diameter being greater than or equal to a minimum third diameter ID3 along said insulator lower end region, wherein said minimum second diameter ID2 and said minimum third diameter ID3 are both greater than said maximum first diameter D1;

a shell formed of metal surrounding said insulator;

said shell having a shell outer surface including a threaded region with a plurality of threads;

said shell having a shell inner surface including a shell lower end region radially aligned with said threaded region;

said shell inner surface presenting a shell inner diameter, said shell inner diameter along said shell lower end region being less than or equal to a maximum inner diameter which is less than said minimum second diameter ID2 and said minimum third diameter ID3 of said insulator outer surface;

said shell including separate pieces;

said shell inner surface conforming with the contour of said insulator intermediate region and at least a portion of said insulator upper end region; and said insulator lower end region extending axially outwardly from a shell lower end of said shell.

9. A corona igniter according to claim 8, wherein said separate pieces include two halves each extending axially from a shell upper end to a shell lower end.

10. A corona igniter according to claim 8, wherein said shell inner surface includes a shell enlarged region disposed between said shell lower end region and said shell upper end, said shell inner diameter along said shell enlarged region is greater than or equal to a minimum upper diameter SD2, said minimum upper diameter is greater than said minimum second diameter ID2 of said insulator outer surface, and said shell enlarged region is provided by a third piece of material separate from said two halves.

11. A corona igniter according to claim 8, wherein said insulator is permanently fixed against being removed axially outwardly from the shell.

12. A method of manufacturing an igniter, comprising the steps of:

providing an insulator having an insulator outer surface including an insulator intermediate region between an insulator upper end region and an insulator lower end region, said insulator outer surface presents an insulator diameter being less than or equal to a maximum first diameter ID1 along the insulator intermediate region, said insulator diameter being greater than or equal to a minimum second diameter ID2 along the insulator upper end region, and the insulator diameter being greater than or equal to a minimum third diameter ID3 along the insulator lower end region, wherein the minimum second diameter ID2 and the minimum third diameter ID3 are both greater than the maximum first diameter D1, and the insulator diameter tapers along a lower portion of the insulator upper end region in a direction moving away from an insulator upper end and ending at the insulator intermediate region;

inserting the insulator lower end region though a shell upper end of a shell formed of metal and past a shell lower end of the shell; and plastically deforming the shell such that a shell inner surface of the shell conforms with the contour of the insulator intermediate region.

13. A method according to claim 12, wherein the plastically deforming step includes a cold forming process or a magnetic pulse forming process.

14. A method according to claim 12, wherein the insulator lower end region extends axially outwardly from a shell lower end of the shell.

15. A method of manufacturing an igniter, comprising the steps of:

providing an insulator having an insulator outer surface including an insulator intermediate region between an insulator upper end region and an insulator lower end region, the insulator outer surface presenting an insulator diameter being less than or equal to a maximum first diameter ID1 along the insulator intermediate region, the insulator diameter being greater than or equal to a minimum second diameter ID2 along the insulator upper end region, and the insulator diameter being greater than or equal to a minimum third diameter ID3 along the insulator lower end region, wherein the minimum second diameter ID2 and the minimum third diameter ID3 are both greater than the maximum first diameter D1; and disposing separate pieces of a shell formed of metal around the insulator outer surface, a shell inner surface of the pieces of the shell conforming with the contour of the insulator intermediate region and at least a portion of the insulator upper end region.

16. A method according to claim 15 including brazing the insulator to the shell.

17. A method according to claim 15, wherein the step of disposing the shell around the insulator includes disposing a shell lower end of the shell axially above the insulator lower end region.

18. A corona igniter according to claim 1, wherein said insulator diameter is constant along an upper portion of said insulator upper end region extending from said insulator upper end to said lower portion of said insulator upper end region;

said insulator diameter is constant along said insulator intermediate region from said insulator upper end region to said insulator lower end region;

said insulator diameter increases abruptly at an interface between said insulator intermediate region and said insulator lower end region; and said insulator diameter is constant along said insulator lower end region.

19. A method of manufacturing an igniter, comprising the steps of:

providing an insulator having an insulator outer surface including an insulator intermediate region between an insulator upper end region and an insulator lower end region, the insulator outer surface presenting an insulator diameter being less than or equal to a maximum first diameter ID1 along the insulator intermediate region, the insulator diameter being greater than or equal to a minimum second diameter ID2 along the insulator upper end region, and the insulator diameter being greater than or equal to a minimum third diameter ID3 along the insulator lower end region, wherein the minimum second diameter ID2 and the minimum third diameter ID3 are both greater than the maximum first diameter D1; and casting a shell formed of metal about the insulator such that a shell inner surface of the shell conforms with the contour of the insulator intermediate region and at least a portion of the insulator upper end region, and a shell lower end of the shell is located axially above the insulator lower end region.

20. A corona igniter according to claim 18, wherein said insulator outer surface includes an insulator nose region extending from said insulator lower end region to an insulator nose end, said insulator diameter decreases abruptly at an interface between said insulator lower end region and said insulator nose region, and said insulator diameter tapers continuously along said insulator nose region to said insulator nose end.

* * * * *